US006655276B1

(12) United States Patent
Dulin et al.

(10) Patent No.: US 6,655,276 B1
(45) Date of Patent: Dec. 2, 2003

(54) DEVICE FOR DRIVING FOLDING ROLLS

(75) Inventors: Brian Arther Dulin, Epping, NH (US); Christian Heinz Miescher, Newburgport, MA (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/521,691

(22) Filed: Mar. 9, 2000

(51) Int. Cl.[7] ..... B41F 13/24
(52) U.S. Cl. ..... 101/247; 101/216; 101/227
(58) Field of Search ..... 101/216, 228, 101/248, 182, 184, 185, 218, 226, 227, 247; 493/356, 357, 359, 360

(56) References Cited

U.S. PATENT DOCUMENTS

| | | | | |
|---|---|---|---|---|
| 1,985,917 A | | 1/1935 | Crafts | 270/77 |
| 3,088,731 A | | 5/1963 | Raybuck | 270/72 |
| 5,080,339 A | | 1/1992 | Hirahara | 270/21.1 |
| 5,397,526 A | * | 3/1995 | Perkins et al. | 100/35 |
| 5,797,319 A | | 8/1998 | Tomczak | 101/216 |
| 5,937,757 A | | 8/1999 | Jackson et al. | 101/232 |

FOREIGN PATENT DOCUMENTS

| | | |
|---|---|---|
| DE | 1246766 | 8/1967 |
| DE | 3228463 | 4/1983 |
| EP | 0170251 | 2/1986 |
| EP | 0400527 | 12/1990 |
| EP | 0928767 | 7/1999 |
| GB | 2106478 | 4/1983 |

OTHER PUBLICATIONS

Braasch, William, *Newspaper Presses*, (1958), pp. 136–154, Ch. 6.

* cited by examiner

*Primary Examiner*—Ren Yan
(74) *Attorney, Agent, or Firm*—Davidson, Davidson & Kappel, LLC

(57) ABSTRACT

A drive for two interacting folding rolls, the drive including a first drive-in gear, a first roll gear driven by the first drive-in gear, a first cover for sealing the first drive-in gear and the first roll gear, a second drive-in gear, a second roll gear driven by the second drive-in gear and adjustable with respect to the first roll gear, and a second cover for sealing the second drive-in gear and the second roll gear. Also provided is a method for sealing a drive of interacting first and second folding cylinders comprising the steps of sealing a first drive-in gear and a first cylinder gear of the first folding cylinder using a first cover, and sealing a second drive-in gear and a second cylinder gear of the second folding cylinder using a second cover, the first cylinder gear being adjustable with respect to the second cylinder gear.

8 Claims, 4 Drawing Sheets

DEVICE FOR DRIVING FOLDING ROLLS

BACKGROUND OF THE INVENTION

1. Field of the Invention

The present invention relates generally to printing presses and more particularly to a device and method for driving folding rolls in a folder.

2. Background Information

Web printing presses print a continuous web of material, such as paper. In a folder of the printing press, the continuous web then is cut into signatures in a cutting unit and folded.

One way to fold the resulting signatures is using a rotary blade folder, which includes a cylinder with rotary blades which provide a fold to the signature. The fold is forced by the blade toward two rotating folding rolls, which grip the signature along the fold at a nip, set the fold and deliver the folded product, for example, to a fan unit. Each of the folding rolls must be driven.

As shown in FIG. 4 herein, in a prior art rotary blade folder the drives for the interacting folding rolls include drive-in gears 1, 2 and roll gears 3, 4. The two drive-in gears 1, 2 interact in a geared 1:1 relationship, and each of the drive-in gears 1, 2 independently drives a roll gear 3, 4 respectively, gears 3 and 4 being coaxial with a respective folding roll. The coaxial gears 3, 4 and the folding rolls are adjustable about centers of gears 1, 2 as shown by arrows 5, 6, so that a nip between the folding rolls can be adjusted, for example to accommodate different printed product thicknesses. A seal or cover 8, shown schematically, generally surrounds all four of the gears of the folder drive, i.e. the two drive-in gears 1,2 and the two coaxial gears 3,4. The seal 8 helps provide for proper lubrication of the gears. However, because the two coaxial gears 3, 4 need to be moved during adjustment of a nip between the folding rolls, the seal 8 typically suffers flexing at location 7, which can lead to breakdown of the seal and/or leakage of lubricating oil.

BRIEF SUMMARY OF THE INVENTION

An object of the present invention is to provide for a device and method for providing improved sealing for gears of a folder drive. An additional or alternative object of the present invention is to provide a high quality folder drive and related method.

The present invention provides a drive for two interacting folding rolls, the drive including a first drive-in gear, a first roll gear driven by the first drive-in gear, a first cover for sealing the first drive-in gear and the first roll gear, a second drive-in gear, a second roll gear driven by the second drive-in gear and adjustable with respect to the first roll gear, and a second cover for sealing the second drive-in gear and the second roll gear.

With the two-seal arrangement of the present invention, flexing or stressing of a seal can be avoided, even during nip adjustment when the first and second roll gears are moved.

The first and second roll gears preferably are coaxial to their respective folder rolls.

The first and second drive-in gears preferably are connected by a first axle and a second axle, respectively, to a first and second drive gears. First and second drive gears preferably intermesh. At least one of the first and second drive gears is connected to a drive motor.

The first and second axles preferably pass through a gear side wall of the folder, the drive-in gears being located inside the gear side wall and the drive gears being located outside the gear side wall.

One of the folding cylinders preferably is a rotary blade folding cylinder.

The first cover preferably is attached to a nip adjustment arm connected to one of the folding rolls, so as to move with the nip adjustment arm.

The present invention also provides a folder for a printing press including a first folding roll, a second folding roll interacting with the first folding roll for processing signatures, a first drive-in gear, a first roll gear connected to the first folding roll and being driven by the first drive-in gear and a first cover for sealing the first drive-in gear and the first roll gear. A second drive-in gear drives a second roll gear connected to the second folding roll, the second roll gear being adjustable with respect to the first roll gear. A second cover seals the second drive-in gear and the second roll gear.

The present invention also provides a method for sealing a drive of interacting first and second folding cylinders comprising the steps of:

sealing a first drive-in gear and a first cylinder gear of the first folding cylinder using a first cover, and sealing a second drive-in gear and a second cylinder gear of the second folding cylinder using a second cover, the first cylinder gear being adjustable with respect to the second cylinder gear.

BRIEF DESCRIPTION OF THE DRAWINGS

A preferred embodiment of the present invention is described below by reference to the following drawings, in which.

DETAILED DESCRIPTION

Figure 1:
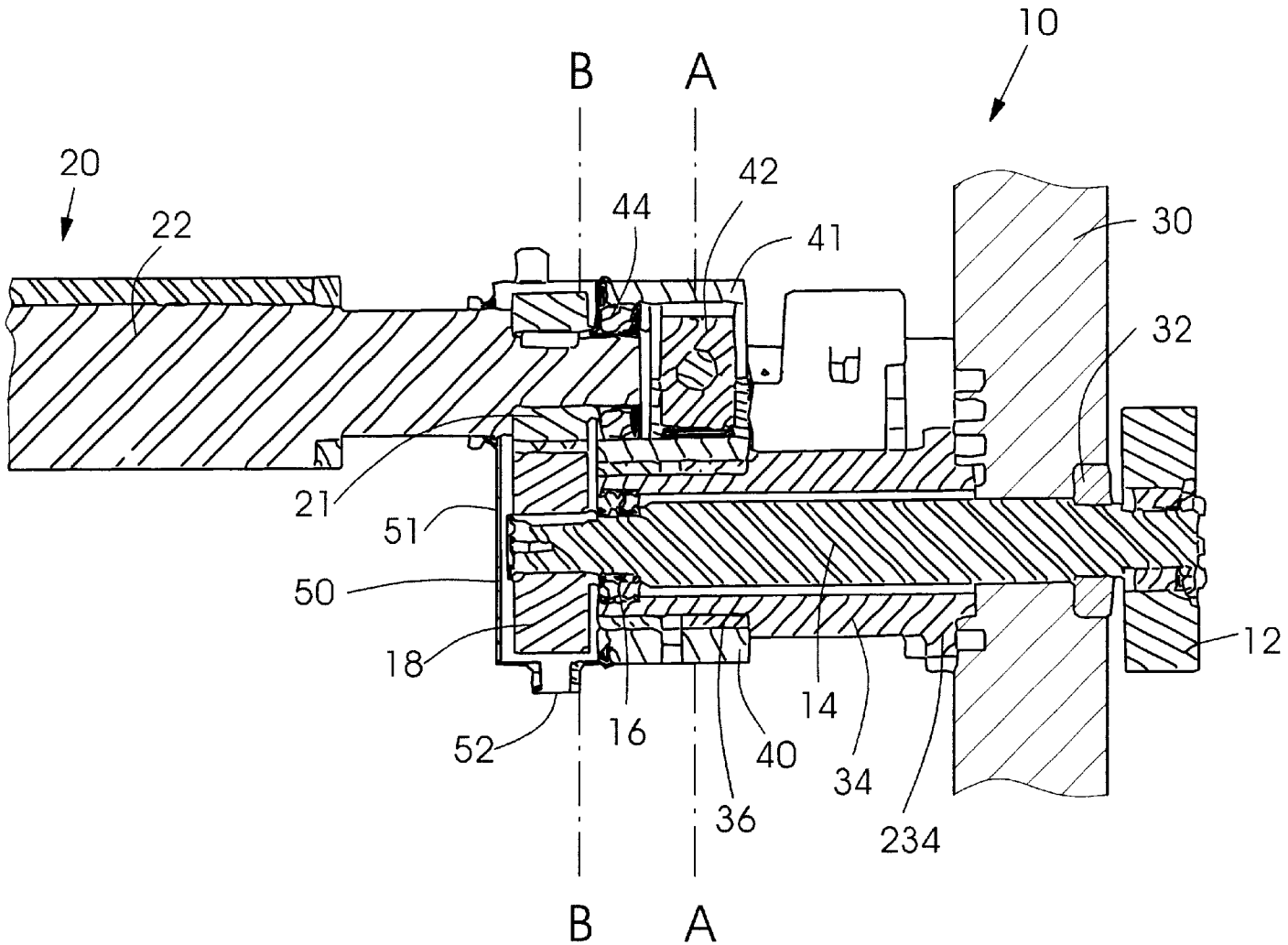
FIG. 1 shows a view of the folder drive of the present invention.

FIG. 1 shows a side view of a drive 10 for a rotary blade folder 20, which includes a folding roll 22. Drive 10 includes a first drive gear 12 which can be driven by a motor, for example. First drive gear 12 rotates an axle 14, which is rotatingly supported in a gear side frame 30 of the folder via bearings 32. Axle 14 is supported on the other end by sealed bearings 16 supported in an extension 34 bolted to frame 30 via an integral end plate 234.

Axle 14 rotates a drive-in gear 18, which is geared, for example in a toothed arrangement, to a roll gear 21 coaxial with the axis of and connected to folding roll 22. The two folding rolls 22, 122 create an ingoing nip. The fold is created with a tucking blade that tucks the cut signature into the ingoing nip of the two folding rolls 22, 122.

Drive gear 12 thus drives folding roll 22 by rotating axle 14, drive-in gear 18 and roll gear 21.

Supported rotatingly by a bearing 36 on the outer side of extension 34 is a nip adjustment arm 40, which is adjustable by a nip adjustment device 42. A top section 41 of nip adjustment arm 40 is connected to folding roll 22 through a bearing 44. The nip adjustment device 42 can move the top section 41 about extension 34 (i.e. generally into and out of the page as shown in FIG. 1), so as to move roll 22, while gears 21 and 18 remain engaged.

A cover 50 seals drive-in gear 18 and roll gear 21. Cover 50 may be for example made of steel, and is attached at one side along or to nip adjustment arm 44 and at the other side 51 with a V-seal sealingly about folding roll 22. At the bottom of cover 50 an oil drain 52 may be provided. Cover 50 thus may move with nip adjustment arm 44 and is not subject to flexing or stress as a result of a nip adjustment of roll 22.

Figure 2:
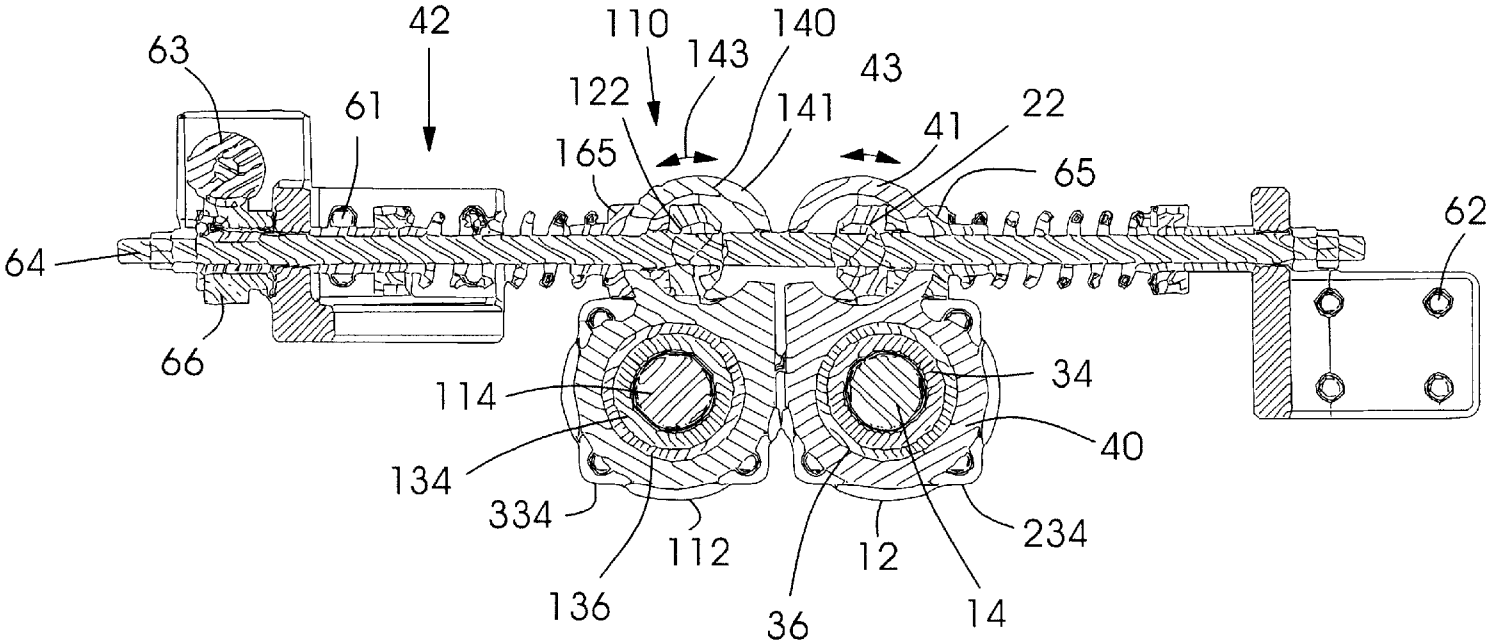
FIG. 2 shows a view of the folder drive of the present invention through section A—A of FIG. 1, with certain features also shown for added clarity.

FIG. 2 shows a view of the folder drive 10 of the present invention through section A—A of FIG. 1, with certain features also shown for added clarity. Nip adjustment arm 40 can rotate about extension 34 and bearing 36 through nip adjustment device 42. Top end 41 of nip adjustment arm 40 moves as indicated by arrow 43, and can move folding roll 22 (shown schematically by a circle with a line) through bearing 44 (FIG. 1).

A second folding roll 122 (also shown schematically) interacts with folding roll 22 in the folder and is driven by a second drive section 110 of drive 10. Second drive section 100 has an axle 114 supported in an extension 134 of gear side frame 30. A bearing 136 permits a second nip adjustment arm 140 to move the second folding roll in direction 143.

Nip adjustment device 42 is connected by bolts 61, 62 to gear side frame 30 (FIG. 1) and includes a worm drive 63 for rotating a screw axle 64 through gear 66. Depending on the rotational direction of screw axle 64, guides 65, 165 move toward each other or apart from each other along screw axle 64 by virtue of the screw motion, i.e. guides 65, 165, which may be spring-loaded, have interior grooves interacting with the screw axle 64. Guides 65, 165 are connected to the top ends 41, 141 of nip adjustment arms 40, 140, respectively, and thus can move the nip adjustment arms 40, 140 about extensions 34, 134. When nip adjustment arm 40 moves, bearings 44 move folding roll 22 as well. Bearings are also provided in nip adjustment arm 140 for folding roll 122.

Thus by rotation of worm drive 63 the nip distance between the folding roller 22 and the second folding roller 122, shown schematically in FIG. 2, can be adjusted.

Also shown for clarity in FIG. 2 are end plates 234 and 334 which are integral with extensions 34 and 134, respectively, and are attached by bolts to frame 30, which is not shown in FIG. 2 for clarity purposes.

Also shown for clarity purposes is drive gear 12, which can be geared outside of frame 30 to a second drive gear 112 driving axle 114.

Figure 3:
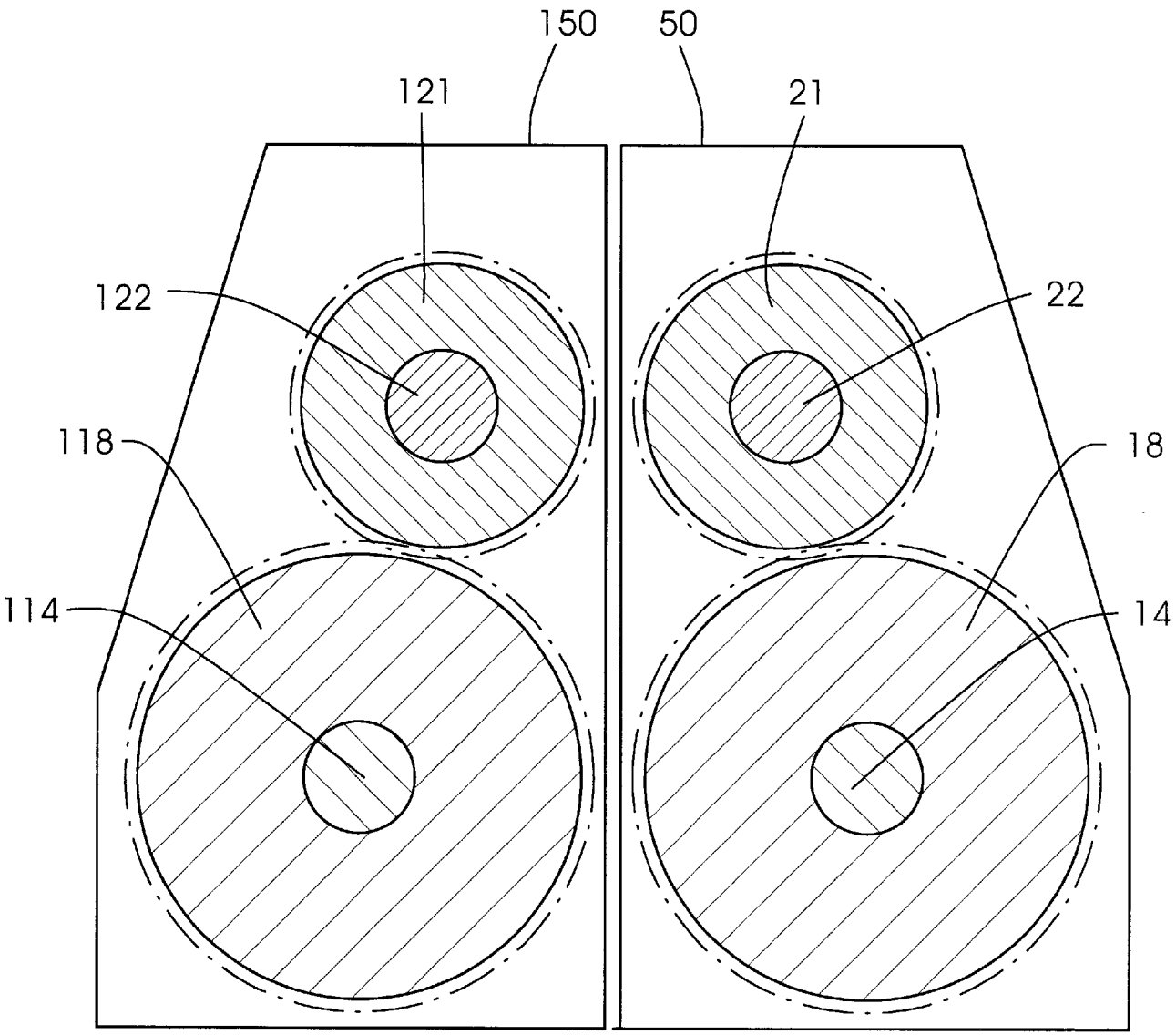
FIG. 3 shows a schematic view of a cut through section B—B of FIG. 1.

FIG. 3 shows second axle 114 driving a second drive-in gear 118, which in turn rotates a second roll gear 121. Second roll gear 121 is coaxial with and drives second folding roller 121. Also shown in FIG. 3 is axle 14, drive-in gear 18, first roll gear 21 and first folding roll 22.

Cover 50 is shown schematically surrounding gears 21 and 18, and is penetrated in a sealed relationship at a first side 51 (FIG. 1) by rotating folding roll 22. Cover 50 on the other side may be attached sealingly to nip adjustment arm 40 (FIG. 2). Thus when nip adjustment arm 40 is moved, cover 50 also moves.

In a similar fashion, a cover 150 seals gears 121 and 118, is penetrated in a sealed relationship by rotating folding roll 22 and can move with second nip adjustment arm 140 (FIG. 2).

The two independent covers 50, 150 thus reduce stresses and possible problems associated with leakage in lubricating the gears 18, 21, 118 and 121.

Figure 4:
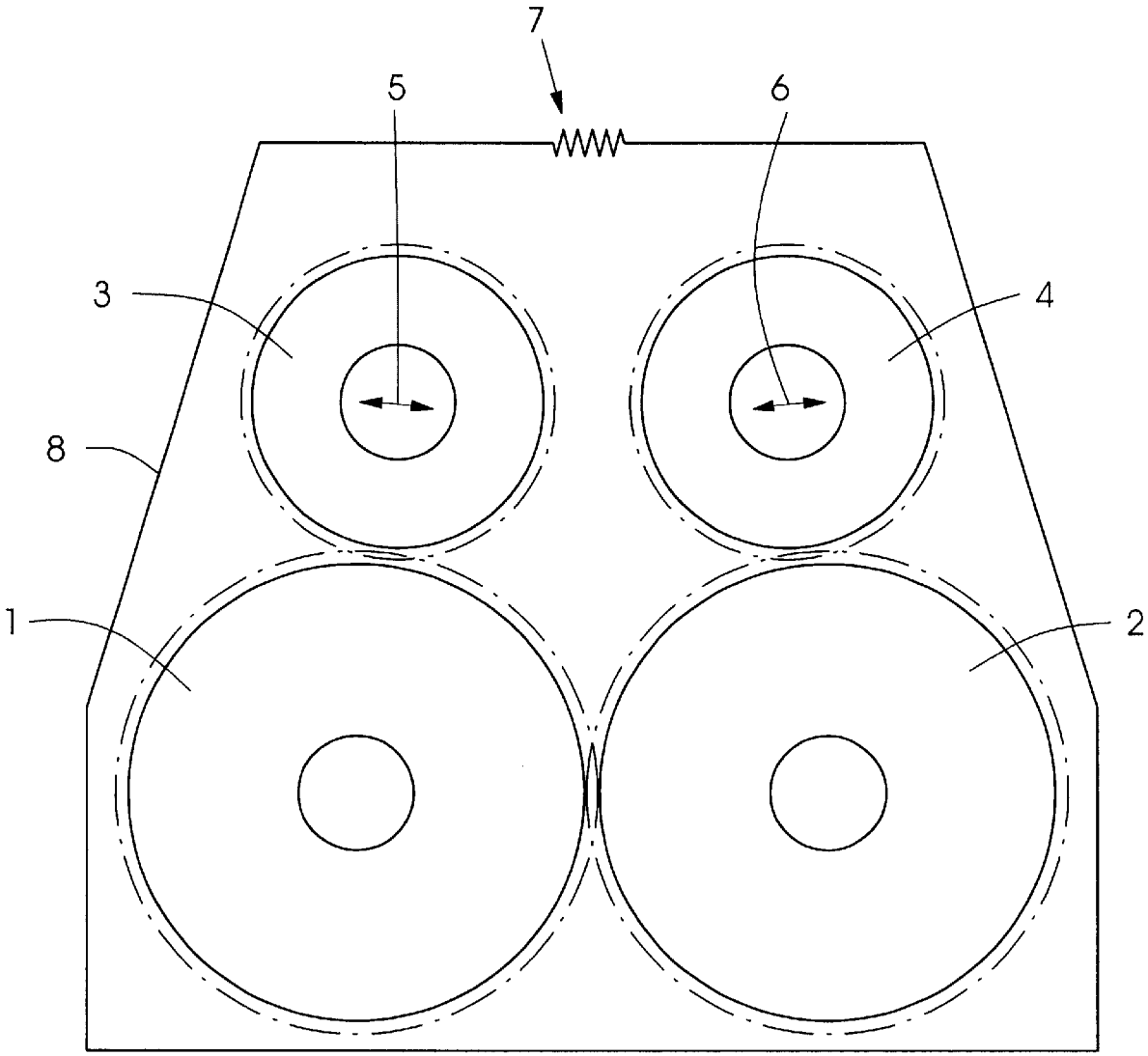
Fig.4 Prior Art
FIG. 4 shows a prior art folder drive.

FIG. 4 shows a prior art folder drive, which is described in the Background Information section herein.

Bearings 44 and 16 and 36 may be seal bearings. Alternatively, cover 50 could have a second side which is penetrated sealingly solely by axle 14 and the far end of roll 22.

What is claimed is:

1. A folder for a printing press comprising:

a first folding roll;

a second folding roll interacting with the first folding roll for processing signatures;

a first drive-in gear;

a first roll gear connected to the first folding roll and being driven by the first drive-in gear;

a first cover for sealing the first drive-in gear and the first roll gear;

a second drive-in gear;

a second roll gear connected to the second folding roll, the second roll gear being driven by the second drive-in gear and adjustable with respect to the first roll gear;

a second cover for sealing the second drive-in gear and the second roll gear; and a nip adjustment arm connected to the first folding roll through a bearing, the first cover being connected to the nip adjustment arm.

2. The folder as recited in claim 1 further including a first axle, a second axle, a first drive gear and a second drive gear, the first and second drive-in gears connected by the first axle and the second axle to the first and second drive gears respectively.

3. The folder as recited in claim 1 wherein the first folding roll passes through the first cover.

4. The folder as recited in claim 1 further comprising a gear side wall of the folder, the first and second drive-in gears being located inside the gear side wall.

5. The folder as recited in claim 4 further comprising a first axle and a first drive gear being located outside the gear side wall, the first axle connected to the first drive-in gear and the first drive gear and being supported rotatingly in the gear side wall.

6. The folder as recited in claim 1 further comprising a nip adjustment device for adjusting a nip between the first folding roll and the second folding roll.

7. The folder as recited in claim 1 wherein the first folding roll is a rotary blade folding cylinder.

8. The folder as recited in claim 1 wherein the folder is a rotary-blade folder.

* * * * *